US009440141B2

(12) United States Patent
Bierly

(10) Patent No.: US 9,440,141 B2
(45) Date of Patent: Sep. 13, 2016

(54) COMPETITIVE GAME WITH SPINNING GAME WHEEL AND PLAYING PIECES

(71) Applicant: Craig Joseph Bierly, Port Deposit, MD (US)

(72) Inventor: Craig Joseph Bierly, Port Deposit, MD (US)

( * ) Notice: Subject to any disclaimer, the term of this patent is extended or adjusted under 35 U.S.C. 154(b) by 0 days.

(21) Appl. No.: 14/335,208

(22) Filed: Jul. 18, 2014

(65) Prior Publication Data

US 2015/0021855 A1 Jan. 22, 2015

Related U.S. Application Data

(60) Provisional application No. 61/856,838, filed on Jul. 22, 2013.

(51) Int. Cl.
*A63F 3/00* (2006.01)
*A63F 5/02* (2006.01)

(52) U.S. Cl.
CPC ..... *A63F 3/00261* (2013.01); *A63F 3/00895* (2013.01); *A63F 5/02* (2013.01); *A63F 2003/00268* (2013.01); *A63F 2250/14* (2013.01)

(58) Field of Classification Search
CPC ..... A63F 3/00261; A63F 3/00895; A63F 2003/00268; A63F 5/02
USPC ..... 273/280, 139, 138.1
See application file for complete search history.

(56) References Cited

U.S. PATENT DOCUMENTS

| | | | | |
|---|---|---|---|---|
| 1,427,135 | A * | 8/1922 | Tenney | 273/142 G |
| 1,492,976 | A * | 5/1924 | Gill | A63B 65/10 482/21 |
| 2,193,896 | A * | 3/1940 | Angst | 273/142 F |
| 2,831,692 | A * | 4/1958 | Keast | 273/145 E |
| 2,839,303 | A * | 6/1958 | Baker | 273/248 |
| 3,203,699 | A * | 8/1965 | Pearson, Jr. | 273/119 A |
| 3,762,714 | A * | 10/1973 | Wilson | 273/248 |
| 3,840,235 | A * | 10/1974 | Breslow | 273/119 A |
| 4,253,669 | A * | 3/1981 | Ferris | A63F 5/02 273/340 |
| 4,549,737 | A * | 10/1985 | Seyer | A63D 15/00 273/118 R |
| 5,201,524 | A * | 4/1993 | Csanady et al. | 273/248 |
| 6,540,229 | B1 * | 4/2003 | Smith | A63F 3/00157 273/274 |
| 2008/0054569 | A1 * | 3/2008 | Medina | A63F 3/02 273/296 |

* cited by examiner

*Primary Examiner* — Vishu Mendiratta
(74) *Attorney, Agent, or Firm* — Invention To Patent Services; Alex R Hobson

(57) ABSTRACT

A competitive table game includes a rapidly spinning game wheel, an annular collection area, a base, and a plurality of rollable playing pieces. The game wheel is rotatably connected onto the base while the annular collection area is concentrically positioned around the game wheel. During each game, the players roll the plurality of rollable playing pieces on a smooth top surface of the game wheel as the plurality of rollable playing pieces is tangentially positioned on the smooth top surface and released attempting to match the linear velocity at the respective position on the game wheel. Then the plurality of rollable playing pieces moves across the smooth top surface and drops into the annular collection area, where the winner of each game is determined according to the game rules of each different game and the positioning of the plurality of rollable playing pieces. Other embodiments are described and shown.

20 Claims, 13 Drawing Sheets

COMPETITIVE GAME WITH SPINNING GAME WHEEL AND PLAYING PIECES

The current application claims a priority to the U.S. Provisional Patent application Ser. No. 61/856,838 filed on Jul. 22, 2013.

FIELD OF THE INVENTION

The present invention relates generally to a single or multi-player table game. More specifically, the present invention is completed with a manual or powered round horizontal spinning game wheel, playing pieces, and a stationary or rotating collection area for the playing pieces to fall into as the collection area also serves as a method of scoring or point multiplier for the games.

BACKGROUND OF THE INVENTION

There are several games of chance that exist (such as roulette and big six wheel). There are several games that require a considerable level of skill or technique (such as bowling, ping pong, horseshoes, billiards or shuffleboard). There are several games that involve dueling game pieces and multi-player competition, and several games that involve some level of entertainment from motion/movement. The present invention relates to game devices and more particularly is directed to a new game that requires exercise of considerable skill as well as luck and utilizes a rapidly spinning flat game wheel and playing pieces. The present invention is a table game that combines skill, luck, and physics in a fun and entertaining manner as the present invention can be played in bars, billiard rooms, college campuses, outdoor (such as backyard or patios), family living rooms, casinos, and any other similar places. The present invention is intended to be played by families and friends, including young and older children, and adults where the present invention provides a competitive and fun game environment for all the players. In several embodiments, the present invention can be affordably manufactured and occupies considerably less space compared to the other game room style games such as billiards or shuffleboard. There are three general stages of play with the present invention as the present invention can be utilized within many different games:

Launch—All players roll their playing pieces onto the rapidly spinning game wheel. Players that do not have a good roll technique (spin rate, angle, etc.) find their playing piece immediately roll off from the game wheel into the collection area. For novice players, rolling aids can be incorporated to launch the game pieces onto the spinning wheel. As player skills improve, different techniques can be utilized to launch the game pieces onto the spinning game wheel depending on the game wheel rotational velocity and location on the game wheel that the game piece is launched. In a game table or casino version of the present invention, all playing pieces can be set into motion at once by a game operator.

Roll—Any playing pieces that are successfully launched with an acceptable roll technique will roll in an unpredictable fashion around the game wheel, loosing speed towards the center of the game wheel and gaining speed towards the edge of the game wheel. The playing pieces can roll and bump into each other as the playing pieces may exit from the game wheel after contact.

Determining the winner—depending on the rules of each different game, the winner of the game is determined upon the positioning of the playing pieces with respect to the game wheel and/or the collection area.

DETAILED DESCRIPTION OF THE INVENTION

All illustrations of the drawings are for the purpose of describing selected versions of the present invention and are not intended to limit the scope of the present invention.

Figure 1:
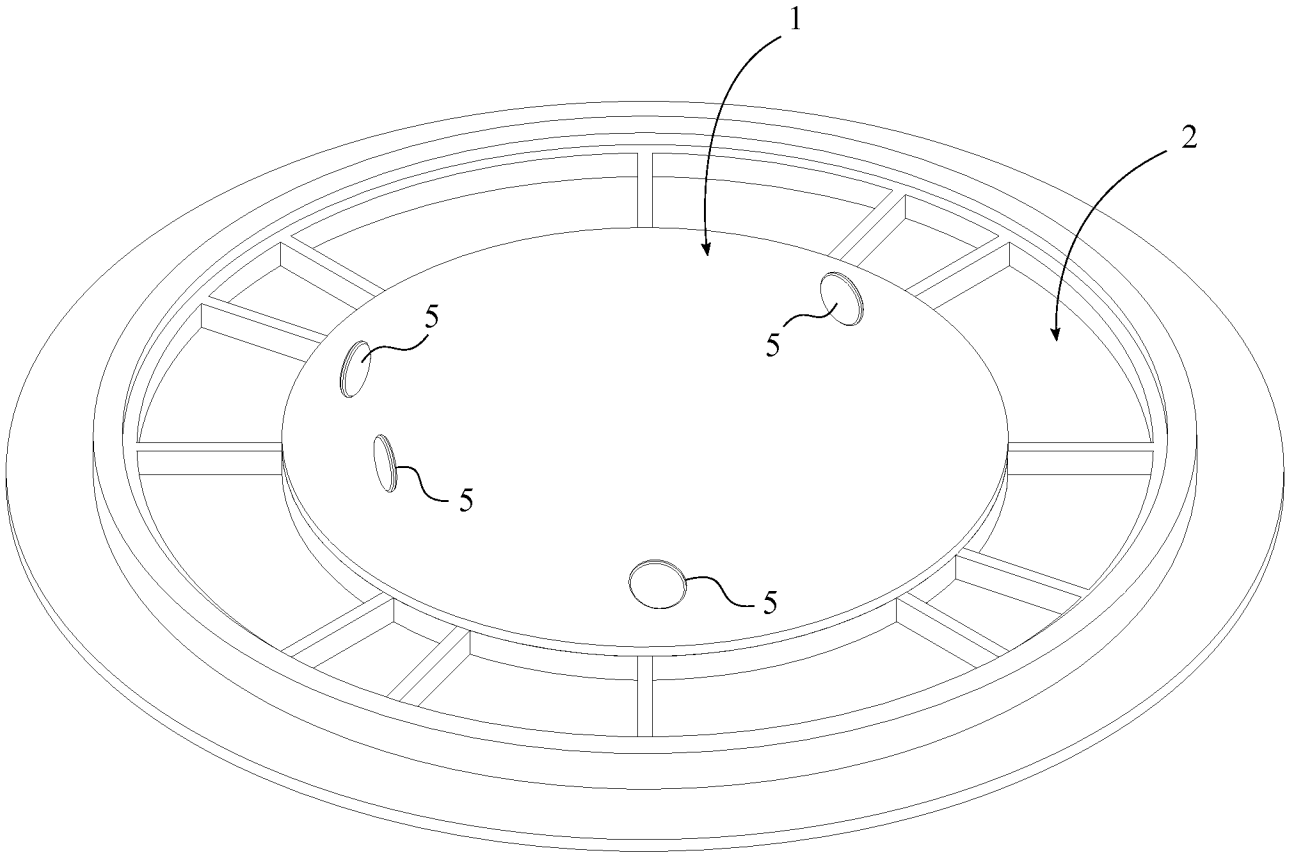
FIG. 1 is a perspective view of the first configuration for the preferred embodiment of the present invention.

The present invention is a competitive game apparatus that can be played by one, two, three, four, or more players. The present invention is configured into different embodiments so that the present invention can be utilized within different environments, such as homes, bars, casinos, billiard rooms, college campuses, outdoor (such as backyard or patios), family living rooms, and lounges. In order to attract a wider range of players and to improve the competitiveness of the present invention, a variety of games can be played within the present invention. In reference to FIG. 1 and FIG. 2, the present invention comprises a game wheel 1, an annular collection area 2, a base 4, and a plurality of rollable playing pieces 5. As for the general configuration of the present invention, the game wheel 1 is rotatably connected to the base 4 while the annular collection area 2 is either rotatably or stationarily connected to the base 4. Additionally, the annular collection area 2 is concentrically positioned around the game wheel 1 as the plurality of rollable playing pieces 5 is adapted to eccentrically move across the game wheel 1 and drop into the annular collection area 2.

Figure 5:
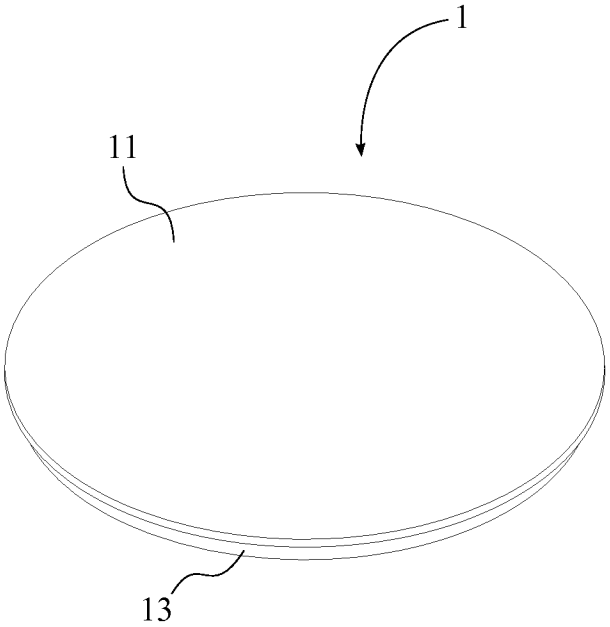
FIG. 5 is a top perspective view of the game wheel of the present invention.
Figure 4:
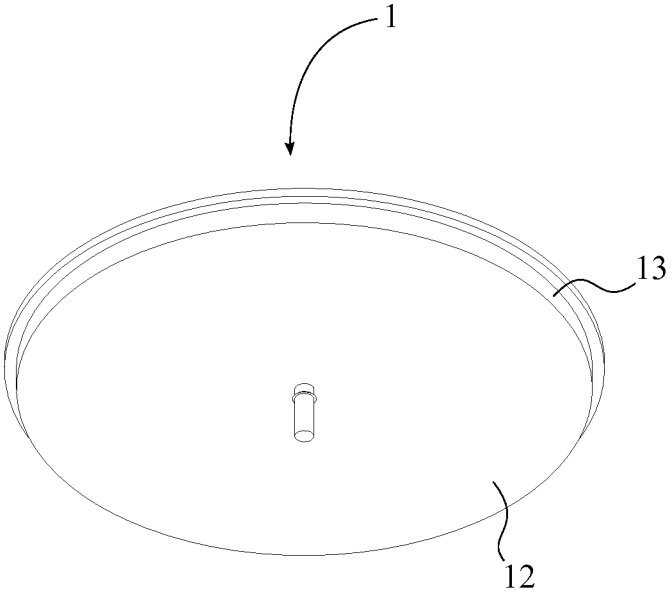
FIG. 4 is a bottom perspective view of the game wheel of the present invention.

The game wheel 1 provides the necessary surface area for the plurality of rollable playing pieces 5 to move within the present invention. The game wheel 1 can be preferably made from smooth or slightly textured and durable materials, such as plastic, composites, acrylic, resin, polycarbonate, wood, or any other type of similar material that can withstand the constant movement of the plurality of rollable playing pieces 5. In reference to FIG. 4 and FIG. 5, the game wheel 1 that is preferably shaped into a circular form comprises a smooth top surface 11, a bottom surface 12, and a lateral surface 13. More specifically, the smooth top surface 11 is oppositely positioned from the bottom surface 12 along the lateral surface 13, forming the game wheel 1. Additionally, the smooth top surface 11 and the bottom surface 12 are perpendicularly positioned with the lateral surface 13 so that the smooth top surface 11 and the bottom surface 12 are able to create parallel flat surfaces within the game wheel 1. The smooth top surface 11 may include slightly curved or angular profiles near the outer rim of the game wheel 1 to increase the spinning time of the plurality of rollable playing pieces 5. The smooth top surface 11 can include a small center ring for additional scoring of the present invention. For example, the small center ring may provide additional points if one of the plurality of rollable playing pieces 5 lands flat within the small center ring. The smooth top surface 11 can also include guide ring markings, where the guide ring markings create a competitive playing environment as the players are required to release the playing pieces in a similar radius of the game wheel 1 while matching the rotational velocity of the game wheel 1. The center of the game wheel 1 may include a cavity or an insertion point for additional accessories of the present invention. For example, a stand can be positioned within the cavity or the insertion point to hold a magnet or sphere as they can affect the outcome of the game. The center of the game wheel 1 can also include at least one marked circle in order to expand the number of games that can be played on the present invention. The bottom surface 12 is adjacently positioned with the base 4 as the bottom surface 12 rotatably connects the game wheel 1 to the base 4. As a result, the smooth top surface 11 is able to provide the necessary surface area for the plurality of rollable playing pieces 5 so that the plurality of rollable playing pieces 5 can be rolled on the smooth top surface 11 according to the different games of the present invention.

Figure 6:
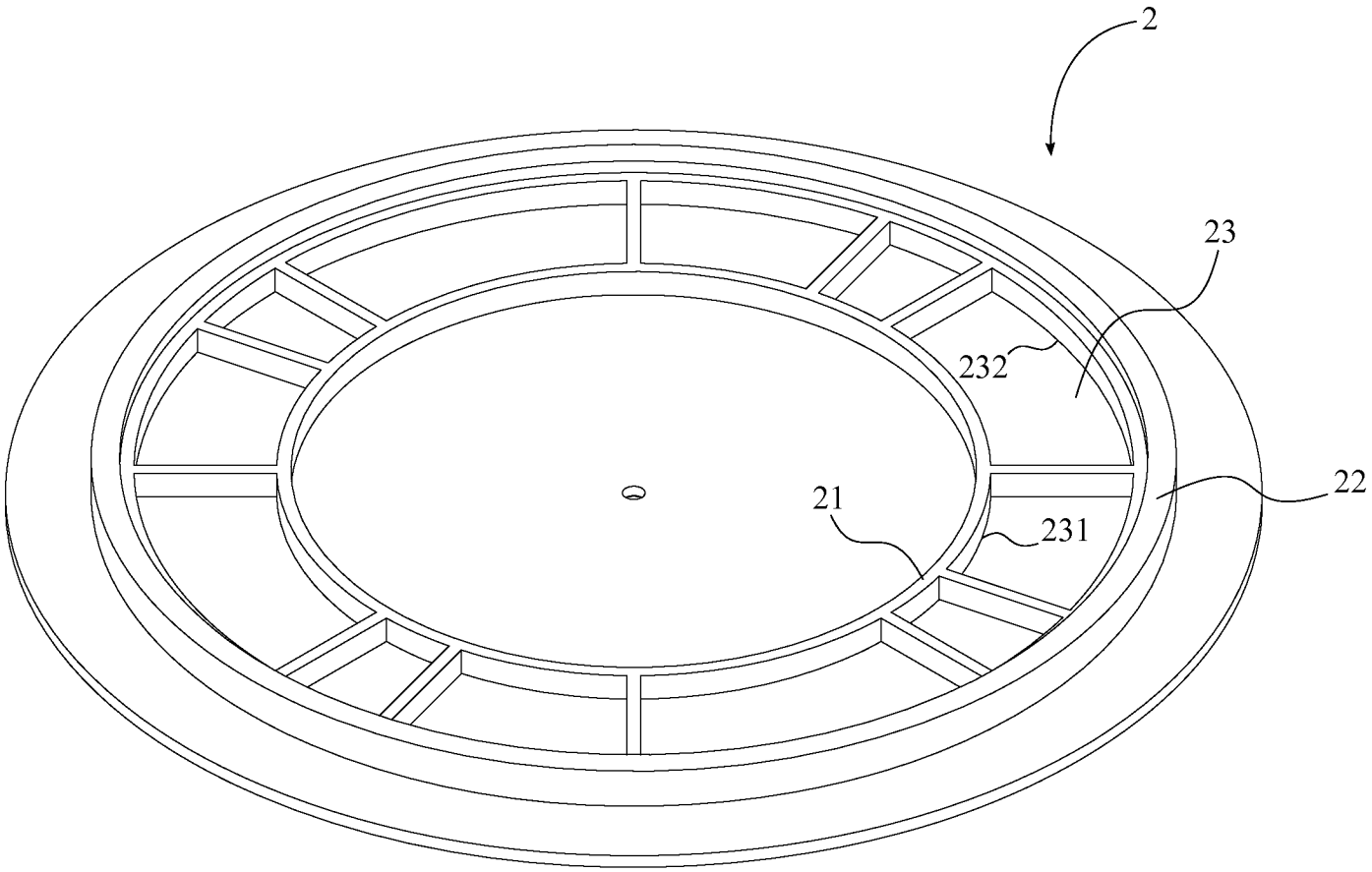
FIG. 6 is a perspective view of the annular collection area of the present invention.
Figure 7:
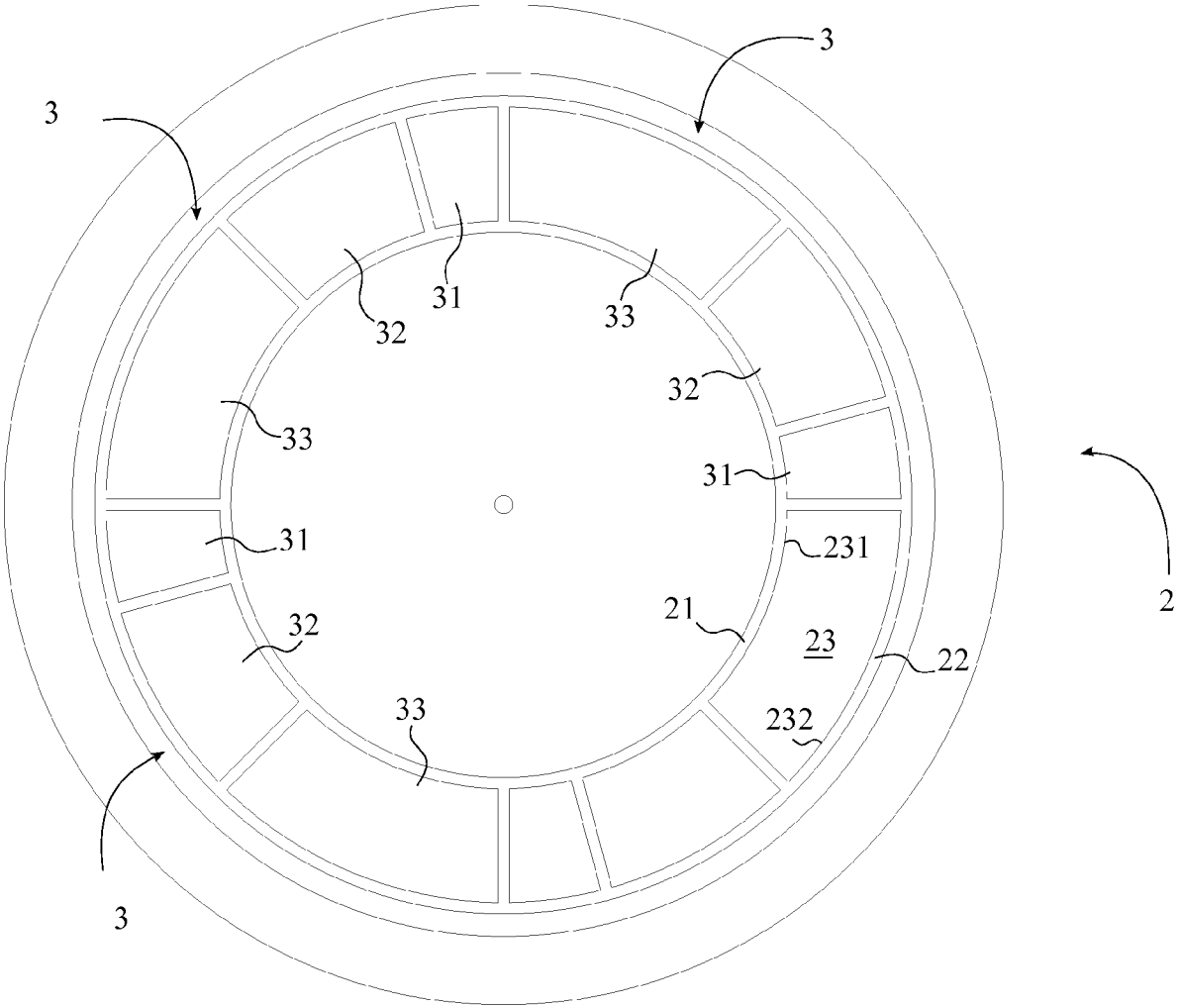
FIG. 7 is a top view of the annular collection area of the present invention.

The annular collection area 2 determines the winning turn for some of the games and/or functions as a point multiplier as the plurality of rollable playing pieces 5 drops into the annular collection area 2. In reference to FIG. 6 and FIG. 7, the annular collection area 2 comprises a first flange 21, a second flange 22, a landing base 23, and a plurality of point weighted sections 3. The first flange 21 is connected to an inner edge 231 of the landing base 23, and the second flange 22 is connected to an outer edge 232 of the landing base 23 in such a way that the first flange 21 and the second flange 22 are perpendicularly positioned with the landing base 23. Each of the plurality of point weighted sections 3 is evenly distributed around the annular collection area 2 in order to enhance the competitiveness of the games that are played on the present invention. Each of the plurality of point weighted sections 3 comprises a small receptacle 31, an intermediate receptacle 32, and a large receptacle 33 as the different size receptacles are able to create different difficulty levels for the plurality of rollable playing pieces 5 to land during each game. More specifically, the small receptacle 31 is adjacently positioned with the intermediate receptacle 32, and the large receptacle 33 is adjacently positioned with the intermediate receptacle 32 while the intermediate receptacle 32 is positioned in between the small receptacle 31 and the large receptacle 33. The small receptacle 31, the intermediate receptacle 32, and the large receptacle 33 may be angled from the first flange 21 to the second flange 22 so that the plurality of rollable playing pieces 5 is easily visible to the players of the present invention. Additionally, the small receptacle 31, the intermediate receptacle 32, and the large receptacle 33 can be lowered or raised so that the present invention can function as a flat-top table when the present invention is not utilized to play games. Although the present invention comprises linear dividing walls that are positioned in between each of the receptacles, the dividing walls can include additional shapes such as, circles (similar to skee-ball), sunrays, flower petals, sport team logos, and any other geometric or organic shapes. The small receptacle 31, the intermediate receptacle 32, and the large receptacle 33 can also be color-coded in order to simplify the scoring methods of the games.

Since the annular collection area 2 is positioned around the game wheel 1, the lateral wall is adjacently positioned with the first flange 21 while the landing base 23 positions parallel with the smooth top surface 11. Due to the concentric positioning of the annular collection area 2 and the adjacent positioning of the lateral surface 13 and the first flange 21, the present invention is able to create a smooth transition for the plurality of rollable playing pieces 5 from the game wheel 1 to the annular collection area 2. More specifically, the smooth top surface 11 is positioned atop the landing base 23 so that the plurality of rollable playing pieces 5 can easily drop into one of the receptacles of the plurality of point weighted sections 3. Although the dividing walls that are positioned in between each of the receptacles includes a squared off top edge, the dividing walls can also be rounded or chamfered to allow a smooth transition for the plurality of rollable playing pieces 5.

Figure 2:
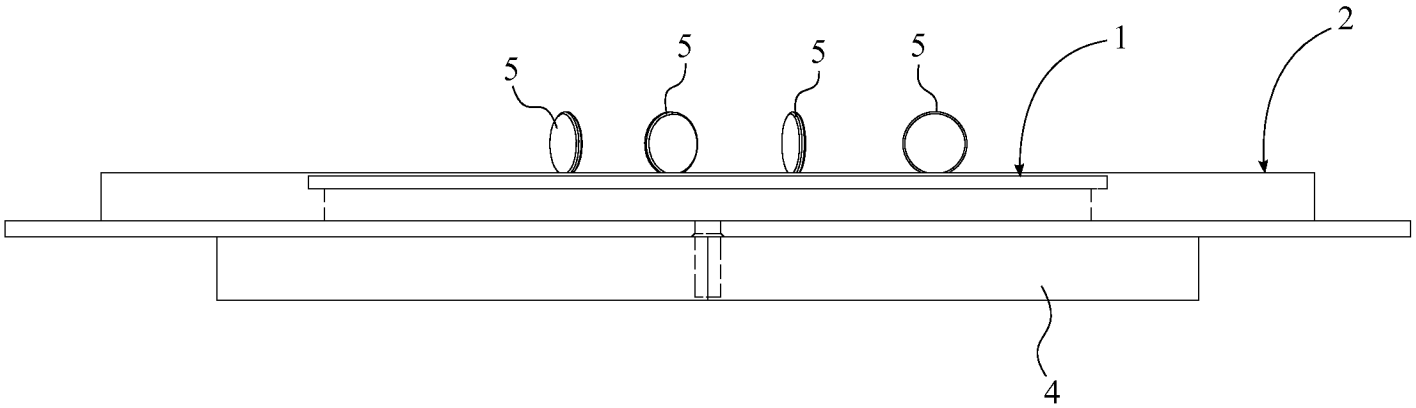
FIG. 2 is a side view of the first configuration for the preferred embodiment of the present invention.

In reference to FIG. 2, the base 4 of the present invention provides the necessary support for the game wheel 1 and the annular collection area 2. The base 4 can be configured into different forms depending on the different embodiments of the present invention. For example, the base 4 can be formed as a game table or a bar table so that the present invention can be utilized within casinos and bars respectively. The base 4 can also be formed as a small platform so that the present invention can function as a portable gaming or toy device. Even though the main functionality of the base 4 is to support the game wheel 1 and the annular collection area 2, the base 4 can provide a variety of other functionalities as follows. The base 4 can be equipped with a wireless router so that the players of the present invention are able to connect their wireless devices into a wireless network through the wireless router. The base 4 can also be equipped with a wireless technology standard for exchanging data over short distances so that the players are able to connect their electronic devices into a personal area network, such as radio frequency technology or infrared technology. The base 4 may also comprise a plurality of embedded speakers and an audio unit to play music so that the music can be played through the audio unit. Additionally, an auxiliary port of the audio unit can accept a portable media player, if a player wants to play music through the portable media player. The base 4 may also comprise a plurality of cup holders, a plurality of cell phone charging ports, at least one score-display system, a plurality of hanging hooks, and a plurality of storage sections for the plurality of rollable playing pieces 5. The base can also equipped with a coin operated system to distribute the plurality of rollable playing pieces 5 for the players, creating arcade version of the present invention.

Figure 3:
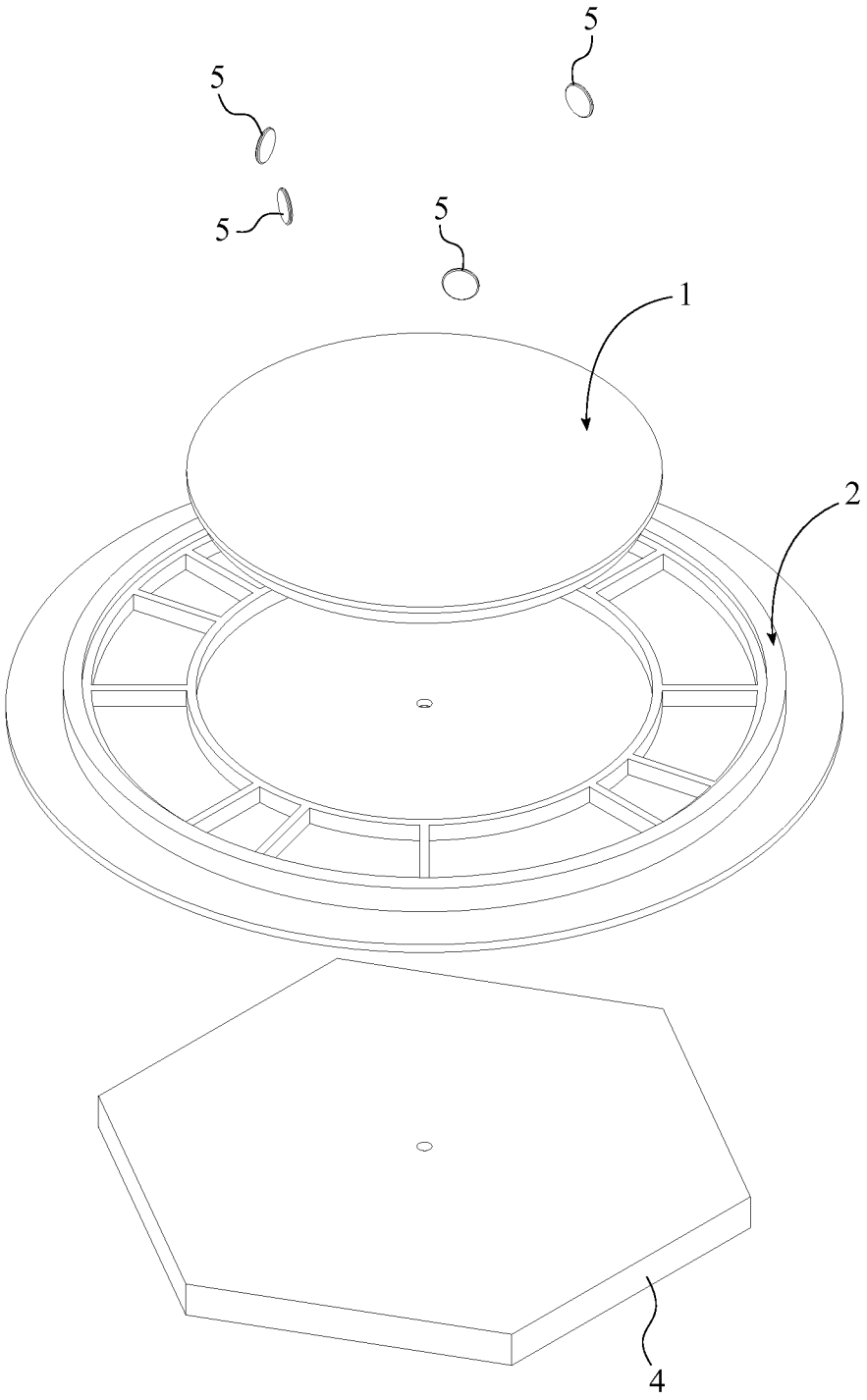
FIG. 3 is an exploded view of the first configuration for the preferred embodiment of the present invention.
Figure 8:
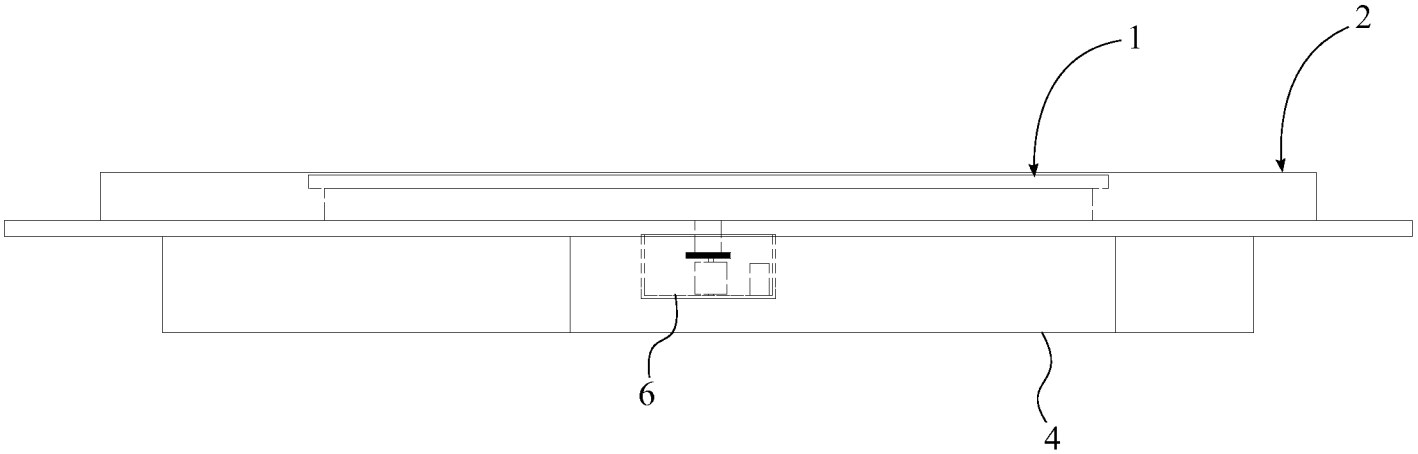
FIG. 8 is a side view of the second configuration for the preferred embodiment of the present invention, showing the rotating mechanism within the base.
Figure 9:
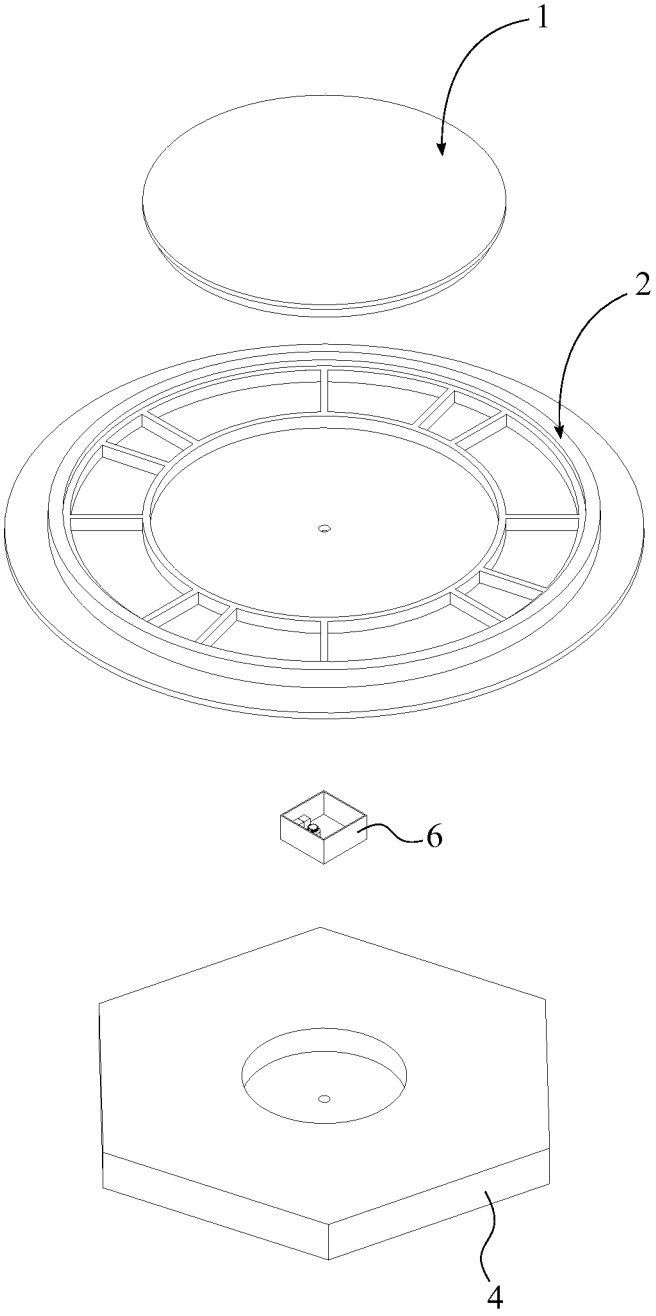
FIG. 9 is an exploded view of the second configuration for the preferred embodiment of the present invention.

In a preferred embodiment of the present invention, the game wheel 1 is axially connected with the base 4 while the annular collection area 2 is stationarily mounted to the base 4. The axial connection between the game wheel 1 and the base 4 allows the players of the preferred embodiment to rotate only the game wheel 1. In reference to FIG. 1-FIG. 3, a first configuration of the preferred embodiment allows the players to manually rotate the game wheel 1 at the beginning of each game. The players can freely rotate the game wheel 1 in either angular direction upon their preference at the start of each game. Once the game wheel 1 is rotated in the clockwise direction or the counterclockwise direction, the players have to continuously rotate the game wheel 1 in the respective angular direction until the game is finished. In order to maintain the angular speed of the game wheel 1, the game wheel 1 may comprise embedded weight on the bottom surface 12 near the lateral surface 13. Since the first configuration of the preferred embodiment does not utilize any complex mechanical systems, the first configuration can be easily manufactured and priced affordably. In reference to FIG. 8-FIG. 9, a second configuration of the preferred embodiment allows the players to control the rotation of the game wheel 1 as the game wheel 1 is operatively coupled to a rotating mechanism 6. The rotating mechanism 6 starts rotating the game wheel 1 in either the clockwise direction or the counterclockwise direction at the beginning of the game and continuously rotates the game wheel 1 during the game. For example, once the rotating mechanism 6 starts the rotation of the game wheel 1 in the clockwise direction or the counterclockwise direction, the rotating mechanism 6 continuously rotates the game wheel 1 in the respective angular direction until game is finished. The rotating mechanism 6 can include, but is not limited to, a belt driven motorized system, a shaft driven motorized system, a gear driven motorized system, an electro-magnetic repulsion system, a forced air system, a mechanical system, or any other type of mechanism that could easily rotate the game wheel 1. In order to ensure proper functionality of the rotating mechanism 6, the rotating mechanism 6 is completed with bearing system, guide wheels, housings, motors, clutches, and other related components. If the rotating mechanism 6 is powered through an external power source, the external power source electrically connects with the rotating mechanism 6 so that the game wheel 1 can be rotated within the present invention. The external power source can include, but is not limited to, a non-rechargeable battery, a rechargeable battery, renewable energy, or alternating current. Additionally, the players can control the angular direction and angular speed of the game wheel 1 through a control panel of the present invention as the control panel is electrically connected in between the external power source and the rotating mechanism 6. For example, the player can control the angular direction and angular speed of the game wheel 1 through a potentiometer of the control panel, preset speed settings of the control panel, or programmable settings. The control panel also provides a kill switch so that the player can stop the operation of the present invention at any given time for safety purposes.

Figure 10:
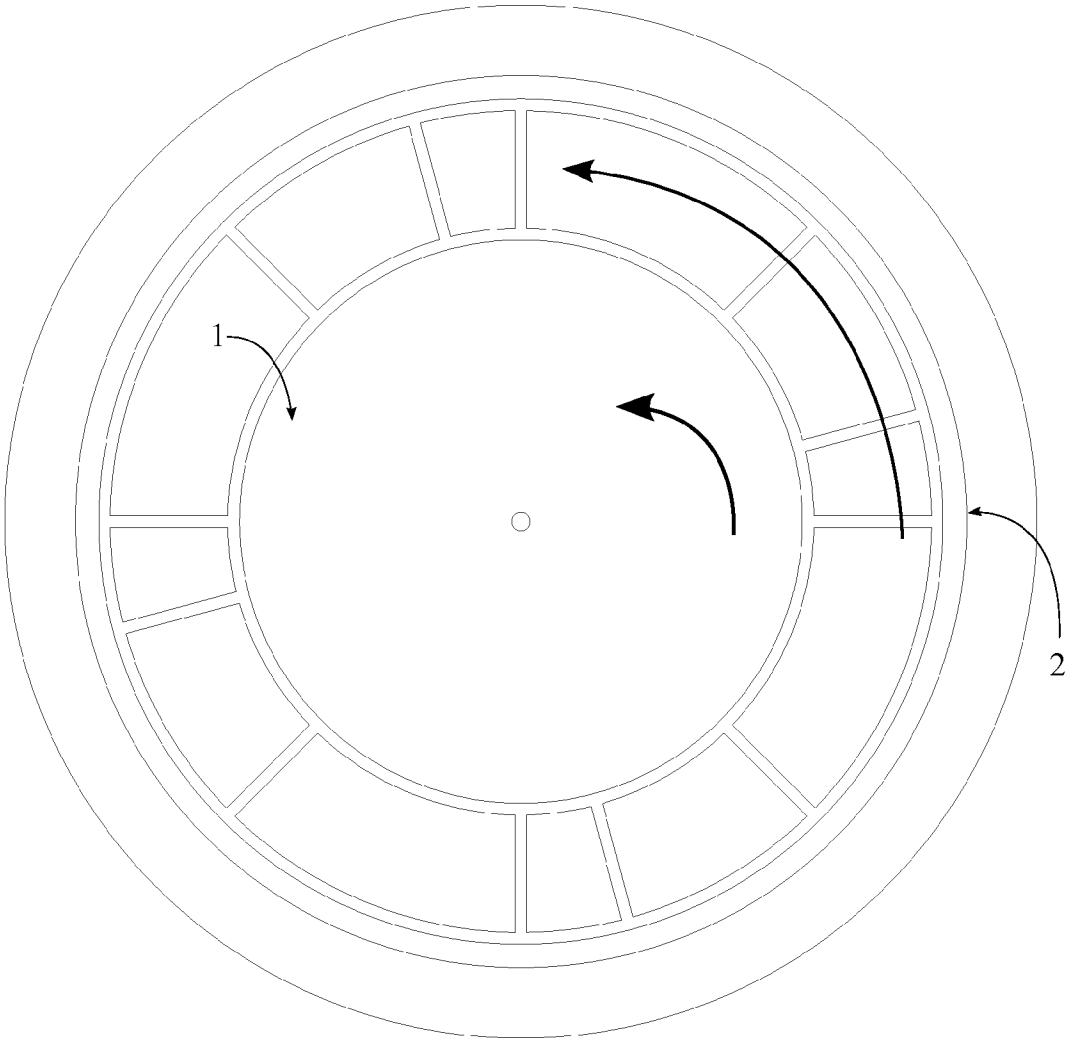
FIG. 10 is a top view of the alternative embodiment of the present invention, wherein the game wheel and the annular collection area rotate in same angular direction.
Figure 11:
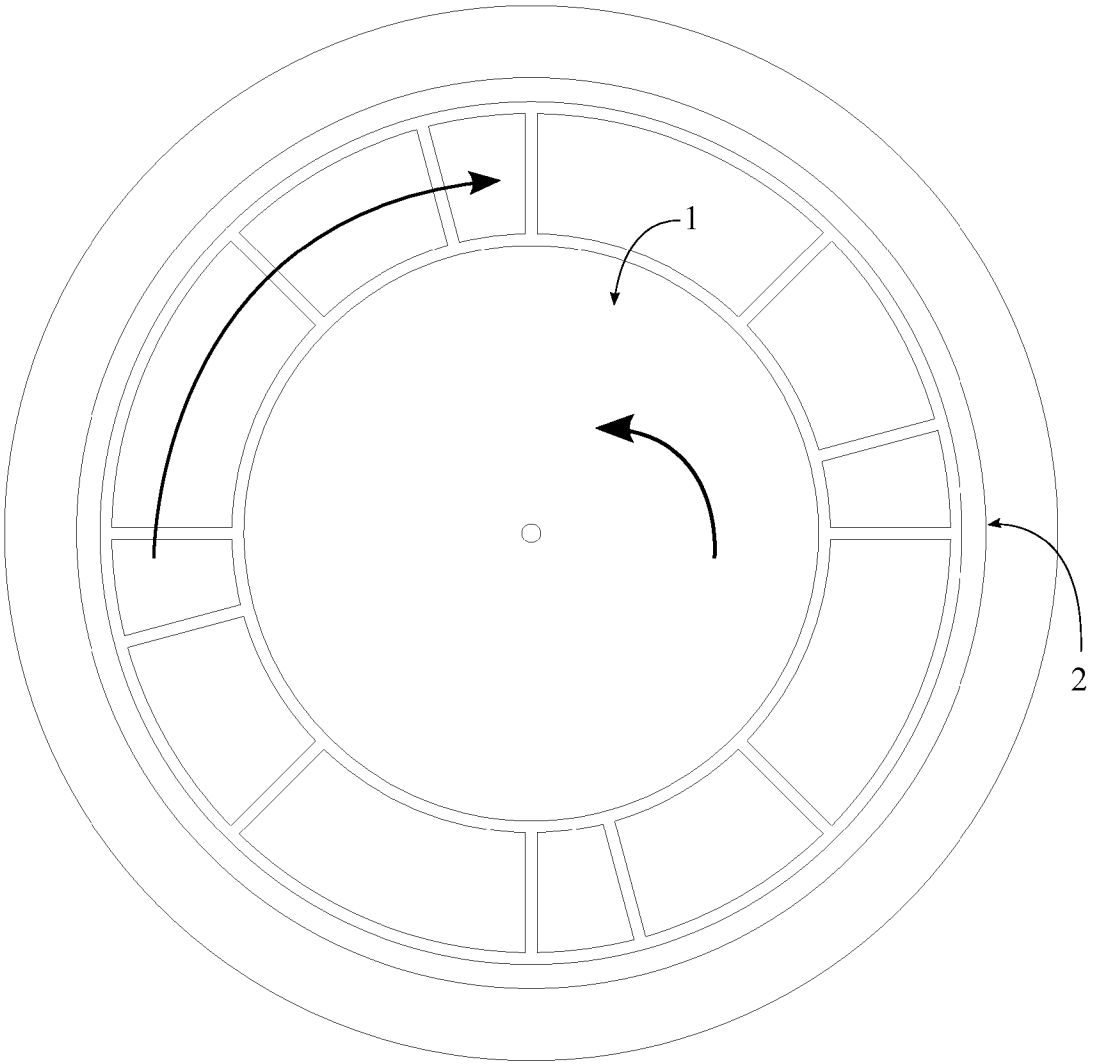
FIG. 11 is a top view of the alternative embodiment of the present invention, wherein the game wheel and the annular collection area rotate in opposite angular directions.

In an alternative embodiment of the present invention, the players can control the rotation of the game wheel 1 and the annular collection area 2 as the game wheel 1 and the annular collection area 2 are rotatably mounted onto the base 4. More specifically, the game wheel 1 is operatively coupled with at least one rotating mechanism 6 while the annular collection area 2 is also operatively coupled with the at least one rotating mechanism 6. The at least one rotating mechanism 6 is able to rotate both the game wheel 1 and the annular collection area 2 within the alternative embodiment. The at least one rotating mechanism 6 rotates the game wheel 1 and the annular collection area 2 in either angular direction at the beginning of the game and continuously rotates the game wheel 1 and the annular collection area 2 in their respective angular direction during the game. In reference to FIG. 10 and FIG. 11, the game wheel 1 and the annular collection area 2 can rotate in the same angular direction or opposite angular directions. Additionally, the players can control the angular direction and angular speed of the game wheel 1 and the annular collection area 2 through the control panel. For example, the player can control the angular direction and angular speed of the game wheel 1 and the annular collection area 2 by adjusting the potentiometer, the preset speed settings, or the programmable settings. Even though the annular collection area 2 of the alternative embodiment suppose to the rotatable, the annular collection area 2 can be stationary positioned by the control panel upon the discretion of the players. In other words, the players can switch the annular collection area 2 in between a rotatable positioning and a stationary positioning through the control panel.

The plurality of rollable playing pieces 5, which are spun on the smooth top surface 11, generally determines the outcome of each game. In the present invention, the plurality of rollable playing pieces 5 is preferably formed into a disc-shaped. Even though the preferred embodiment comprises the disc-shaped plurality of rollable playing pieces 5, the plurality of rollable playing pieces 5 for present invention can include, but is not limited to, spherical shape, circular shapes, and any other type of rollable shapes. The plurality of rollable playing pieces 5 is preferably made from hard but dampened materials such as, plastic, composite, polycarbonate, acrylic, wood, hard rubber, silicon or combination of materials. A center of the each of the plurality of rollable playing pieces 5 is generally filled with material adding mass, such as metal disc or ring, magnetic disc or ring, or clay. When the plurality of rollable playing pieces 5 is spun on the smooth top surface 11, the plurality of rollable playing pieces 5 is tangentially positioned on the smooth top surface 11 and rolled in a manner as to match the linear velocity at the respective location on the smooth top surface 11. More specifically, when the plurality of rollable playing pieces 5 is spun on the smooth top surface 11, the plurality of rollable playing pieces 5 is eccentrically moved across the smooth top surface 11 before falling into the annular collection area 2. Each of the plurality of rollable playing pieces 5 comprises a rolling surface and a central portion, where the rolling surface is perimetrically positioned around the central portion to form the each of the plurality of rollable playing pieces 5. The rolling surface can be shaped into many different forms so that the different forms of rolling surfaces are able to provide different rolling characteristics for the plurality of rollable playing pieces 5. For example, the rolling surface can be shaped into a flat surface in order to maximize the surface area in between the rolling surface and the smooth top surface 11. However, if the rolling surface is shaped into a tapered surface, a circular surface, or a point surface, the surface area in between the rolling surface and the smooth top surface 11 can be minimized. The central portion, which aids the players to grip each of the plurality of rollable playing pieces 5, is shaped into different forms. For example, the central portion can be tapered inward, notched, protruded, and slanted inward from each side. The central portion may additionally comprise an opening or ball-bearing as the opening or the ball-bearing is concentrically traversed through the central portion. The different shapes of central portions provide different comfort levels for the players of the present invention and aid in matching the linear velocity of the smooth top surface 11 during the spinning process of the plurality of rollable playing pieces 5. For example, if the plurality of rollable playing pieces 5 comprises the opening, the players can hold each of the plurality of rollable playing pieces 5 with two fingers through the opening. As a result, the players are able to easily spin the plurality of rollable playing pieces 5.

Figure 12:
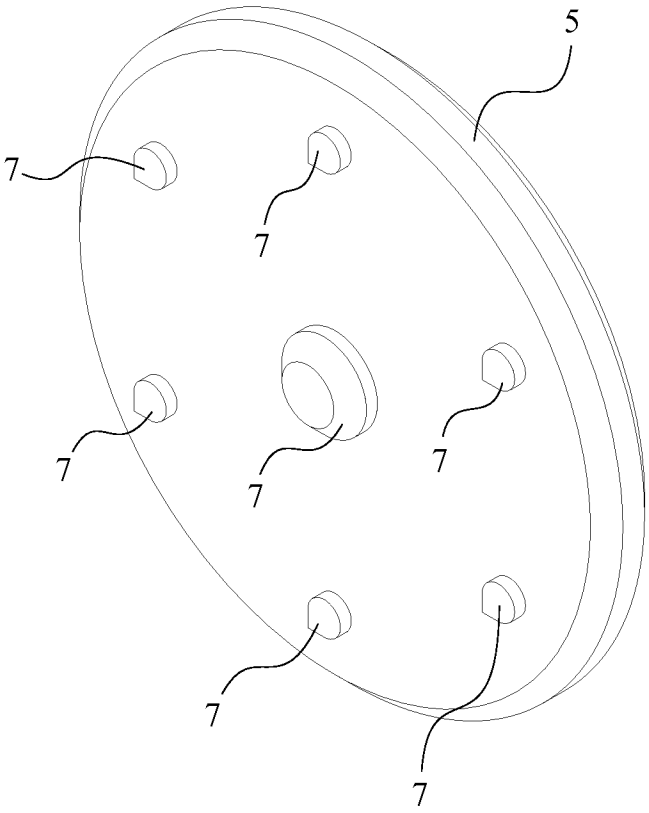
FIG. 12 is a perspective view of one of the plurality of rollable playing pieces showing the plurality of customizable accessories.

In reference to FIG. 12, the plurality of rollable playing pieces 5 comprises a plurality of customizable accessories 7, where the plurality of customizable accessories 7 changes the appearance of the plurality of rollable playing pieces 5. Before the each of the plurality of rollable playing pieces 5 is spun on the smooth top surface 11, at least one accessory from the plurality of customizable accessories 7 is selectively mounted onto each of the plurality of rollable playing pieces 5 upon the players' discretion. The players generally have the option to use the plurality of rollable playing pieces 5 with or without the plurality of customizable accessories 7 as the plurality of customizable accessories 7 can include, but is not limited to, added weights, decorations, magnets, spikes, hooks, pins, protrusions, decorative jewels, polymer rings, enclosed covers, lights, sound emitting devices, and themed characters. For example, the added weights can be mounted to one side of the plurality of rollable playing pieces 5 with the intent of having the heavier side towards the center of the game wheel 1. As a result, the plurality of rollable playing pieces 5 leans toward the middle of the game wheel 1 with the natural tendency of the game wheel 1 to force out the plurality of rollable playing pieces 5. In order to accept the plurality of customizable accessories 7, each of the plurality of rollable playing pieces 5 may comprise a plurality of attachment holes. The plurality of attachment holes is either partially traversed into or fully traversed through each of the plurality of rollable playing pieces 5 and concentrically and evenly distributed with respect to the rolling surface so that the plurality of customizable accessories 7 can be evenly or unevenly positioned on the plurality of rollable playing pieces 5 upon the discretion of the players. More specifically, the plurality of customizable accessories 7 can be slightly imbalance from one side to other side, but the plurality of customizable accessories 7 must be radially balanced about either side of the plurality of rollable playing pieces 5 to prevent any kind of skip or chatter.

Figure 13:
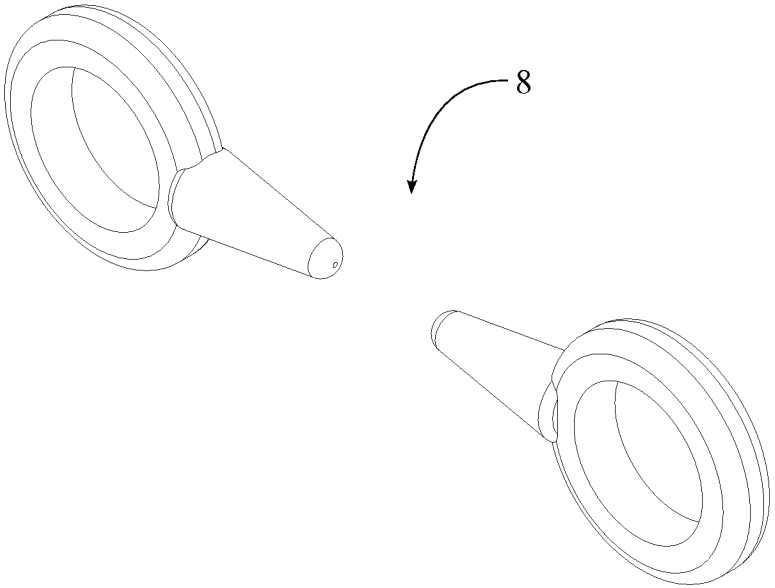
FIG. 13 is a perspective view of the pair of finger attachments.
Figure 15:
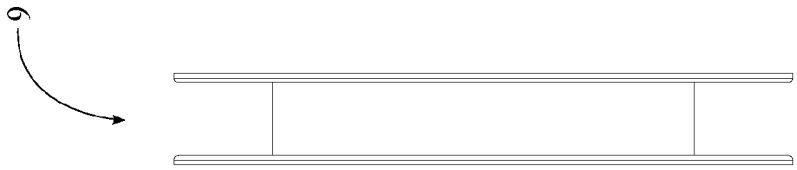
FIG. 15 is a side view of the rolling aid.
Figure 14:
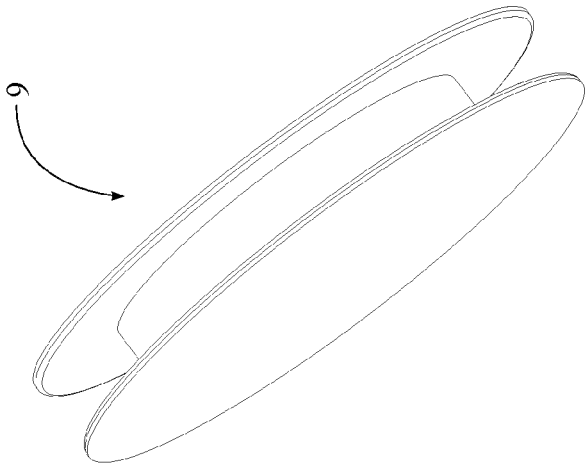
FIG. 14 is a perspective view of the rolling aid.

The general launching method for the plurality of rollable playing pieces 5 comprises the steps of: Manually spinning each of the plurality of rollable playing pieces 5 using a flick of the wrist or rolling it from the fingertips to release the respective rollable playing pieces 5. More specifically, the plurality of rollable playing pieces 5 is released not only tangent to the smooth top surface 11 but also parallel to the lateral surface 13 and perpendicular to the center of the game wheel 1. Otherwise the plurality of rollable playing pieces 5 quickly falls from the game wheel 1. The plurality of rollable playing pieces 5 is also released at a speed close to the game wheel 1 and facing the respective angular direction of the game wheel 1. In order to properly master the launching method, the players need to practice the launching method. However, the plurality of rollable playing pieces 5 can further comprise a pair of finger attachments 8 that is preferably formed to match with the central portion of the plurality of rollable playing pieces 5 or a rolling aid 9. In reference to FIG. 13, each of the finger attachment 8 comprises a ring portion and an overhang portion as the ring portion is linearly connects with the overhang portion. The ring portions secure the pair of finger attachments 8 to the fingers of the player while the overhang portions secure one of the plurality of rollable playing pieces 5 to the pair of finger attachments 8. For example, a pair of cone-shaped finger attachments 8 matches with a notched central portion for each of the plurality of rollable playing pieces 5 so that the players are able to achieve the correct speed and the angle for the plurality of rollable playing pieces 5 before releasing them onto the smooth top surface 11. The pair of finger attachments allows players to successfully and efficiently participate within the games that are played on the present invention while the players are able to master the launching method for the plurality of rollable playing pieces 5. A protrusion from the plurality of customizable accessories 7 can also be inserted through the ball-bearing if each of the plurality of rollable playing pieces 5 comprises the ball-bearing within the central portion. Then the protrusion aids the player to primarily hold and spin the plurality of rollable playing pieces 5. In reference to FIG. 14 and FIG. 15, the rolling aid 9 that is primarily used with the disc-shaped rollable playing pieces 5 allows the player or the operator of the present invention to rotate at least one rollable playing pieces 5, where the player is able to match the rotational speed of the at least one rollable playing pieces 5 with the rotational speed of the game wheel 1. More specifically, the rolling aid 9 comprises at least one retainer opening as the at least one retainer opening accepts one of the plurality of rollable playing pieces 5. A first extremity and a second extremity of the rolling aid 9 are squeezed to contain the at least one rollable playing piece 5 within the at least one retainer opening of the rolling aid 9. Then the at least one rollable playing piece 5 is engaged with the smooth top surface 11. Once the at least one rollable playing piece 5 reaches same velocity as the game wheel 1, the player or the operator can release the first and second extremity which then release the at least rollable playing piece 5 onto the smooth top surface 11.

Since the plurality of rollable playing pieces 5 can be simultaneously positioned on the game wheel 1 and can exit the game wheel 1 at the same time, human eye may not be sufficient enough to determine the accurate results of the games. In order to accurately determine the winner of each game and to avoid any disagreement in between the players, the game wheel 1 and the plurality of rollable playing pieces 5 can each comprise an embedded sensor, load cell detecting weight, or a radio-frequency identification (RFID) unit so that the present invention is able to accurately track and determine the positioning of the plurality of rollable playing pieces 5 with respect to the game wheel 1. The embedded sensors or the RFID units of the game wheel 1 and the plurality of rollable playing pieces 5 communicate with the at least one score-display system of the present invention so that the present invention is able to correctly determine and display the accurate results to the players. Accurate results can also be determined in a plurality of additional ways, such as through optical systems, lasers, magnets, etc.

Although the invention has been explained in relation to its preferred embodiment, it is to be understood that many other possible modifications and variations can be made without departing from the spirit and scope of the invention as hereinafter claimed.

What is claimed is:

1. A competitive game with spinning game wheel and playing pieces comprising:

a plurality of disc shaped rollable playing pieces:

two substantially parallel sides, and an outer perimeter that is substantially circular in shape defining a disc-edge;

a base;

a game wheel rotatably connected to the base and comprising;

a smooth top surface that is substantially flat, exposed to game players and configured to receive said plurality of disc shaped rollable playing pieces while said game wheel is rapidly spinning:

a bottom surface; and a lateral surface;

a rotating mechanism comprising a motor that rapidly spins the game wheel at a set speed during game play;

wherein the game wheel is rapidly spun with respect to said base that is stationary;

an annular collection area concentrically positioned around the game wheel and comprising:

a first flange configured around and adjacent to the lateral surface of the game wheel;

a second flange offset radially from first flange; and a landing base configured between the first flange and the second flange;

a plurality of dividing walls that extend from the first flange to the second flange that create a plurality of receptacles within the annular collection area comprising:

a small receptacle, an intermediate receptacle, and a large receptacle;

wherein said small receptacle, intermediate receptacle and large receptacle define a point weighted section for a game player;

a plurality of game scoring locations comprising:

said point weighted section; and at least a portion of the smooth top surface;

whereby in use, the plurality of disc shaped rollable playing pieces are released onto the smooth top surface of the game wheel and roll across the game wheel where they drop into one of the plurality of receptacles within the annular collection area or land on the smooth top surface.

2. The competitive game with spinning game wheel and playing pieces as claimed in claim 1, wherein the smooth top surface and the bottom surface are perpendicularly positioned with the lateral surface.

3. The competitive game with spinning game wheel and playing pieces as claimed in claim 1, wherein the first flange is connected to an inner edge of the landing base;

the second flange is connected to an outer edge of the landing base; and the first flange and the second flange are perpendicularly positioned with respect to the landing base.

4. The competitive game with spinning game wheel and playing pieces as claimed in claim 1, wherein each of the plurality of point weighted sections are evenly distributed around the annular collection area.

5. The competitive game with spinning game wheel and playing pieces as claimed in claim 4, wherein the small receptacle is adjacently positioned with the intermediate receptacle;

wherein the large receptacle is adjacently positioned with the intermediate receptacle; and wherein the intermediate receptacle is positioned in between the small receptacle and the large receptacle.

6. The competitive game with spinning game wheel and playing pieces as claimed in claim 1, wherein the lateral surface is adjacently positioned with the first flange;

wherein the landing base is positioned parallel with the smooth top surface; and wherein the smooth top surface of the game wheel is positioned above the landing base.

7. The competitive game with spinning game wheel and playing pieces as claimed in claim 1, wherein the annular collection area is stationarily mounted to the base.

8. The competitive game with spinning game wheel and playing pieces as claimed in claim 7, wherein the smaller receptacle has a higher point value than said intermediate and large receptacles; and wherein the intermediate receptacle has a higher point value than said large receptacle.

9. The competitive game with spinning game wheel and playing pieces as claimed in claim 1, wherein the rotating mechanism rotates the game wheel and the annular collection area that is operatively coupled with the rotating mechanism.

10. The competitive game with spinning game wheel and playing pieces as claimed in claim 9, wherein the game wheel and the annular collection area are rotated in the same angular direction.

11. The competitive game with spinning game wheel and playing pieces as claimed in claim 9, wherein the game wheel and the annular collection area are rotated in opposite angular directions.

12. The competitive game with spinning game wheel and playing pieces as claimed in claim 1, wherein the motor is adjustable speed motor.

13. The competitive game with spinning game wheel and playing pieces as claimed in claim 12, wherein at least one of the plurality of disc shaped rollable playing pieces comprises a customizable accessory attached to one of said substantially parallel sides; and wherein said at least one of the plurality of disc shaped rollable playing pieces is configured to eccentrically move across the smooth top surface and into one of the plurality of annular collection areas.

14. The competitive game with spinning game wheel and playing pieces as claimed in claim 1, wherein at least one of the plurality of disc shaped rollable playing pieces comprises a customizable accessory attached to one of said substantially parallel sides;

wherein the customizable accessory is configured to attach to a side of one of said plurality of disc shaped rollable playing pieces to radially balance said disc shaped rollable playing piece.

15. A competitive game with spinning game wheel and playing pieces comprises:

a plurality of disc shaped rollable playing pieces comprising:

two substantially parallel sides, and an outer perimeter that is substantially circular in shape defining a disc-edge;

a base;

a game wheel rotatably connected to the base and comprising;

a smooth top surface that is substantially flat; exposed to game players and configured to receive said plurality of disc shaped rollable playing pieces while said game wheel is spinning;

a bottom surface; and a lateral surface;

a rotating mechanism comprising a motor that spins the game wheel at a set speed during game play:

wherein the game wheel spins with respect to said base that is stationary;

an annular collection area concentrically positioned around the game wheel and comprising:

a first flange configured around and adjacent to the lateral surface of the game wheel;

a second flange offset radially from first flange; and a landing base configured between the first flange and the second flange;

a plurality of dividing walls that extend from the first flange to the second flange that create a plurality of receptacles within the annular collection area;

a plurality of customizable accessories;

wherein at least one of the plurality of disc shaped rollable playing pieces comprises one of said plurality of customizable accessories attached to one of said substantially parallel sides for added weight and making said side heavier than the other side a plurality of game scoring locations comprising:

at least a portion of the plurality of receptacles; and at least a portion of the smooth top surface;

whereby in use, the plurality of disc shaped rollable playing pieces are released onto the smooth top surface of the game wheel and roll across the game wheel where they drop into one of the plurality in annular collection areas or land on the smooth top surface;

wherein the plurality of annular collection areas are stationary with respect to the rapidly spinning game wheel.

16. The competitive game with spinning game wheel and playing pieces as claimed in claim 15, wherein the smooth top surface is oppositely positioned from the bottom surface along the lateral surface;

wherein the smooth top surface and the bottom surface are perpendicularly positioned with the lateral surface;

wherein the first flange is connected to an inner edge of the landing base;

wherein the second flange is connected to an outer edge of the landing base; and wherein the first flange and the second flange are perpendicularly positioned with the landing base.

17. The competitive game with spinning game wheel and playing pieces as claimed in claim 15, wherein the annular collection area further comprises a plurality of point weighted sections; and wherein each of the plurality of point weighted sections are evenly distributed around the annular collection area.

18. The competitive game with spinning game wheel and playing pieces as claimed in claim 17, wherein each of the plurality of point weighted sections comprises:

a small receptacle, an intermediate receptacle, and a large receptacle;

wherein the smaller receptacle has a higher point value than said intermediate and large receptacles; and wherein the intermediate receptacle has a higher point value than said large receptacle.

19. The competitive game with spinning game wheel and playing pieces as claimed in claim 15; wherein the motor is an adjustable speed motor wherein the landing base is positioned parallel with the smooth top surface;

wherein the smooth top surface is positioned above the landing base.

20. The competitive game with spinning game wheel and playing pieces as claimed in claim 15, further comprising at least one rolling aid comprising:

a retainer opening positioned between a first and second extremity, wherein the retainer opening is configured to receive a disc edge of one of said plurality of disc shaped rollable playing pieces and the first and second extremities are configured to extend down over the sides of said disc shaped rollable playing piece;

whereby in use, said rolling aid is used to retain a disc shaped rollable playing piece as it is positioned and released onto the rotating smooth top surface of the game wheel.

* * * * *